United States Patent [19]

Waegemann

[11] 4,300,848

[45] Nov. 17, 1981

[54] BINDER FOR PAPER SHEETS WITH PRE-FORMED HOLES

[76] Inventor: C. Peter Waegemann, 392 Jerusalem Rd., Cohasset, Mass. 02025

[21] Appl. No.: 51,962

[22] Filed: Jun. 25, 1979

[51] Int. Cl.[3] ..... B42F 13/02; B42F 13/10

[52] U.S. Cl. ..... 402/13; 402/14

[58] Field of Search ..... 402/20, 22, 63, 68, 402/80 P, 5, 8, 13, 15, 14; 24/153

[56] References Cited

U.S. PATENT DOCUMENTS

| | | | |
|---|---|---|---|
| 379,375 | 3/1888 | Delano | 402/68 X |
| 2,749,589 | 6/1956 | Carman Jr. | 402/19 X |
| 3,074,133 | 1/1963 | Jones | 24/153 R X |
| 3,307,234 | 3/1967 | Murphy | 402/14 |
| 3,534,447 | 10/1970 | Muirhead | 402/14 X |
| 3,994,606 | 11/1976 | Messmer | 402/22 X |

FOREIGN PATENT DOCUMENTS

| | | | |
|---|---|---|---|
| 221517 | 4/1910 | Fed. Rep. of Germany | 402/5 |
| 943446 | 12/1963 | United Kingdom | 402/63 |

*Primary Examiner*—Paul A. Bell
*Assistant Examiner*—John S. Brown
*Attorney, Agent, or Firm*—Morse, Altman, Oates & Dacey

[57] ABSTRACT

A device is provided for binding together sheets of paper formed with two or more spaced holes and attaching the same to a folder or the like. The binder preferably is injection molded of a semi-flexible material and is formed with a flat backing plate and at least a pair of stems which initially are parallel to one another and perpendicular to the backing plate. The stems are spaced apart by a distance equal to the spacing between the holes in the paper and are formed with co-operating male and female elements along the length thereof which allow the stems to be folded one against the other in locking engagement. Each stem is provided with a hinged stop at the free end thereof, which stop folds in against the stem while papers are being inserted or removed and swings out perpendicular to the length of the stem to prevent accidental separation of papers from the stem. Extension pieces are connectable to the ends of the stems and are provided with stop means at the ends thereof. The extension pieces allow a group of papers to be transferred quickly from the stems to the extension pieces in order to remove one or more inner sheets and then replace the top most sheets without disturbing their alignment.

13 Claims, 33 Drawing Figures

BINDER FOR PAPER SHEETS WITH PRE-FORMED HOLES

BACKGROUND OF THE INVENTION

1. Field of the Invention

This invention relates generally to devices for binding sheets of paper formed with two or more holes, and more particularly is directed towards a new and improved binder which readily accommodates a stack of paper of different thicknesses and which prevents accidental separation of sheets from the binder.

2. Description of the Prior Art

It is common practice to bind together loose sheets of papers, often to a heavy backing sheet or in a folder, by punching two holes in the upper or side margins of the sheets and binding them to a folder by means of a fastener comprised of a relatively thin strip of metal having a cross piece and a pair of forwardly projecting tabs. The tabs extend through the punched holes and are adapted to fold over on top of the stack of paper to secure the stack in place. A compressor bar in the form of a plate with an opening at each end may be added and slide rings may be utilized to hold the tabs flat against the compressor bar.

While such devices have been in common use for many years, they suffer from certain disadvantages. For example, the thin strips of metal tend to cut into the paper so that sheets in a bound stack of papers which is in frequent use tend to become torn, particularly around the punched holes, allowing sheets to separate from the stack. Also, the metal strips tend to be rather sharp and a person using such devices may cut his hands if he is not careful. A more serious drawback of prior art devices is that when papers are being stacked onto the device, the top most sheets easily become displaced, until all papers are in place and the binder locked. Furthermore, the separation of an inner sheet from the stack is extremely difficult since those papers on top of the stack must first be removed, the selected sheet or sheets separated and the papers restacked. Since restacking involves threading the tabs back through the holes, particular care must be taken to keep the holes in registration.

Accordingly, it is an object of the present invention to provide improvements in binders for sheets of paper having preformed holes.

Another object of this invention is to provide improvements in binding devices for stacks of paper which allow easy separation of inner sheets without disturbing the alignment of other sheets thereon.

Still another object of this invention is to provide a device for binding a stack of paper which locks each sheet onto the device when placed thereon.

SUMMARY OF THE INVENTION

This invention features a device for binding a stack of paper sheets formed with at least a pair of evenly spaced holes, comprising a flat base portion adapted to be located at the bottom of the stack and spanning the holes. At least a pair of stems extend perpendicularly upwards from the top face of the base portion and are spaced apart by a distance corresponding to the spacing between the holes for insertion through the holes. The stems are formed with male and female cooperating locking positions along the lengths thereof whereby, when one stem is folded over and pressed against another folded stem, they will lock together, binding the stack in place. Articulated stop means are provided at the free end of each stem to prevent accidental displacement of sheets placed on the stems. Detachable sheet accumulation means are provided which connect to the ends of the stems for temporary transfer from the binder to allow removal of one or more inner sheets while the remaining portion of the stack is kept organized.

BRIEF DESCRIPTION OF THE DRAWINGS

FIG. 16 is a detailed side view showing the stems and locking elements in different positions.

DETAILED DESCRIPTION OF THE PREFERRED EMBODIMENTS

Figure 1:
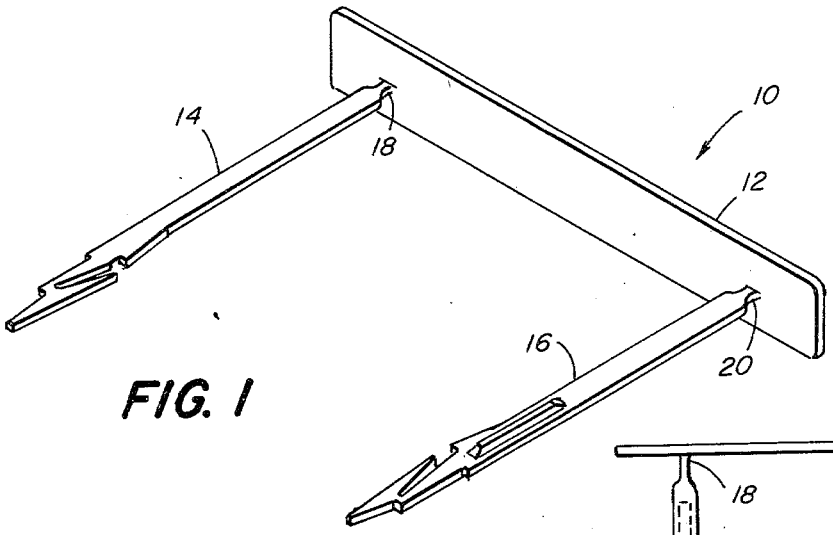
FIG. 1 is a view in perspective of a paper binding device made according to the invention.

Referring now to the drawings, the reference character 10 generally indicates a clamp or binder made according to the invention for use in securing together individual sheets of paper into a stack. The binder 10 is intended for use with sheets of paper which have been formed with at least a pair of evenly spaced holes. The holes in a group of paper sheets, being evenly spaced, would be in register with one another when the papers are arranged in a stack. The holes may be pre-formed by any one of several well known ways as punching, drilling, or the like. Typically, the spacing between the holes is approximately 2-$\frac{3}{4}$" on centers for papers to be bound at their upper margins. The spacing distance is only by way of example and difference spacings may be provided for other types of binding uses. For example, for a stack of papers being bound along their side margins, the spacing between the holes usually would be somewhat greater.

In any event, the binder 10, as best shown in FIG. 1, is comprised of a flat and relatively thin base portion or cross-piece 12, preferably rectangular in outline and serving as a backing plate. Typical standard dimensions for the base portion 12 would be 2-$\frac{3}{4}$"×1, 3-$\frac{1}{4}$"×1, 4-$\frac{1}{4}$"×1 and 8-$\frac{1}{2}$"×1. The binder preferably is made of a semi-flexible plastic material by injection molding techniques and, for this purpose, polypropylene, nylon or other suitable material may be used.

Figure 16:
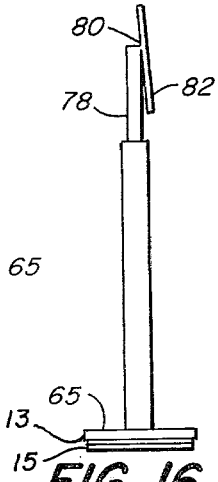
FIG. 16 is a view in side elevation of the device showing the hinged stop piece in a position for feeding and removing sheets from the stem.
Figure 17:
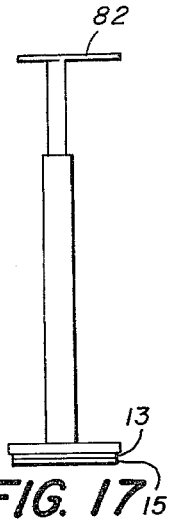
FIG. 17 is a view similar to FIG. 16 but showing the hinged stop piece in a blocking position.

If the binder 10 is to be attached to a folder, the bottom face of the base plate 12 may be covered with a pressure sensitive adhesive stratum which may be covered by a release sheet until ready for use (as shown at 13 and 15, respectively, in FIGS. 16 and 17). The device is installed on the folder by peeling off the release sheet and pressing the bottom face of the base portion flat against the folder in the desired position. If the binder is to be used by itself without a folder or other backing member, then no pressure sensitive adhesive material need be employed. Alternatively, the device could be attached by other means such as rivets, heat sealing, or the like, or the device could be used to clamp the paper and the folder together in a single stack.

Figure 5:
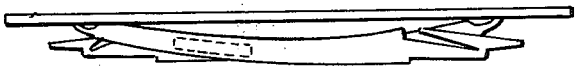
FIG. 5 is a view similar to FIG. 3 but showing the device in a locked position.
Figure 30:
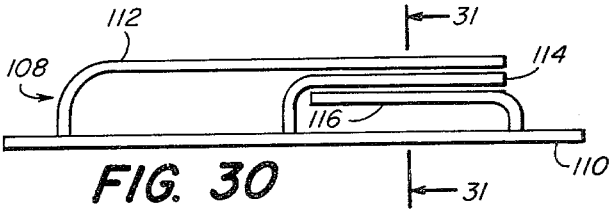
FIG. 30 is a top plan view showing a paper binding device for use with papers formed with three holes.
Figure 31:
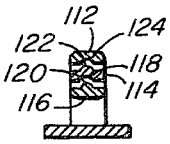
FIG. 31 is a cross-sectional view taken along the line 31—31 of FIG. 30.

Extending perpendicularly upwards from the top face of the base portion 12 is a pair of parallel stems 14 and 16 formed integral with the base portion 12. The stems 14 and 16 extending upwardly from the base member 12 should be of substantially equal length, which length should generally correspond with the distance between the two stems so that, when folded one against the other, as suggested in FIG. 5, the two stems will at least partially overlap for reasons that will presently appear. While FIG. 1 shows a binder with two stems, the device could be made with additional stems and a three-stem binder is illustrated in FIGS. 30 and 31. In practice the length of the stems may be on the order of 1" to 4", each with a thickness of approximately $\frac{1}{8}$". All of these dimensions are only by way of example and may be increased or decreased as desired to suit particular applications.

Figure 6:
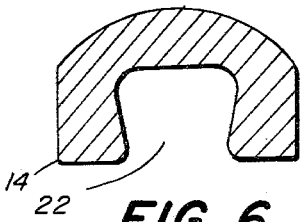
FIG. 6 is a cross-sectional view taken along the line 6—6 of FIG. 3.

The stems 14 and 16 are of somewhat similar construction, each being of substantially the same length and each attached to the base member 12 by means of reduced neck portions 18 and 20 providing a hinge between the stems and the base member and permitting the stems to be folded easily with respect to the base portion. The length of each stem generally should exceed the distance between the two stems so that the stems will overlap to some extent when folded over against the stack of paper which has been placed on the stems. By way of example, the length of the stems may be on the order of perhaps 3-$\frac{3}{4}$" where the stems are spaced apart by a distance of perhaps 2.8 ". The stem 14 in the FIG. 1 embodiment is perhaps 0.16 inches in width and perhaps 0.10 inches deep. The rear face of the stem is somewhat rounded in cross-section, as shown in FIG. 6, while the front face thereof is formed with a longitudinal groove 22 which is wider at the base than at its mouth.

Figure 3:
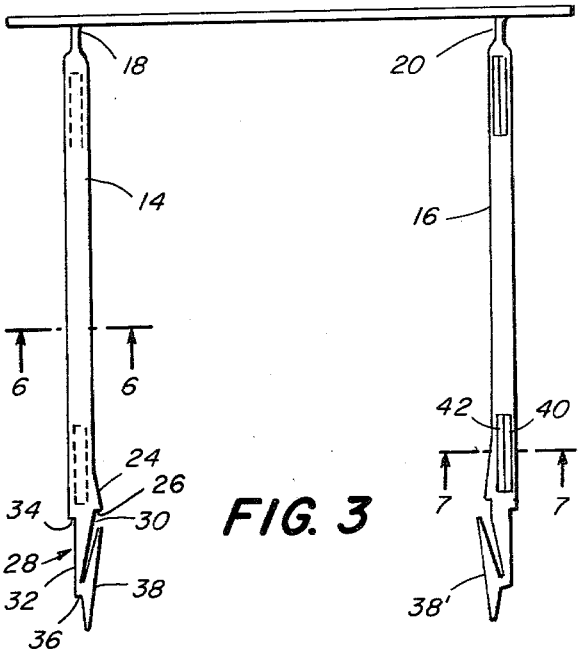
FIG. 3 is a front elevation view thereof.
Figure 4:
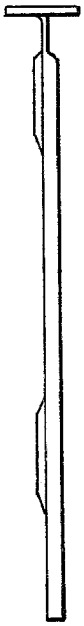
FIG. 4 is a side elevation view thereof.

The shank portion of the stem 14 is generally straight along its side edges, but at its outer end is formed with a sloped edge 24 terminating at a shoulder 26 from which extends a finger portion 28 of somewhat pointed configuration defined by an inclined edge 30 on one side and a straight edge 32 on the opposite side. The straight edge 32 is set in from the side edge of the stem to define a shoulder 34 therewith. Pivotally connected to the end of the finger 28 by means of a living hinge 36 is a stop bar 38 which normally is folded generally parallel to the stem in the recess formed by the shoulder 26 and the edge 30 at the end of the stem. In the position shown in FIG. 3 the stop bar 38 allows punched paper to be threaded easily on and off the stem in the usual manner. However, if the stop bar 38 is pivoted 90° so as to be perpendicular to the length of the stem, it will effectively lock removal of paper from the end of the stem. The stop bar 38 for a stem of the size described, typically is about 0.070 inches in length with the outer end somewhat shorter than the inner end. The inner end terminates close to the shoulder 26 whereby the sloped edge 24 and the outer face of the stop bar 38 define a substantially continuous surface to facilitate insertion and removal of paper on and from the stem.

Figure 7:
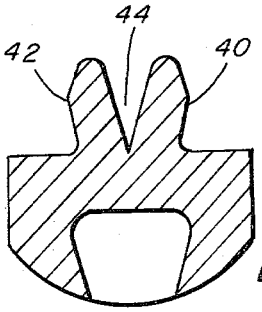
FIG. 7 is a cross-sectional view taken along the line 7—7 of FIG. 3.

The stem 16 is of a construction similar to that of the stem 18 in that it is substantially the same length, is connected to the base portion by reduced neck 20 and is formed with a stop bar 38' of matching configuration to stop bar 38. The outer end of the stem 16 is a mirror image of the outer end of the stem 18. The primary difference between the two stems resides in longitudinal ribs 40 and 42 formed lengthwise in the stem 18 near the outer end thereof. The diverging ribs 40 and 42, as shown in FIG. 7, are separated from one another by means of a Vee groove 44 which allows the ribs to close against one another when the ribs 40 and 42 are forced into the cooperating groove 22 of the stem 14. The ribs 40 and 42, in the illustrated embodiment, extend along only a portion of the length of the stem 16 although in practice they could extend the entire length thereof or may be divided into two or more segments spaced along the stem. In any event, the ribs provide means for locking the stems together when folded over alongside one another in the manner suggested in FIG. 5. In this position the stems are side by side and pressed together to force the ribs 40 and 42 of the stem 16 into the groove 22 of the stem 14, thereby locking the stems together.

The stems are readily released by merely pulling them apart sidewise.

Figure 2:
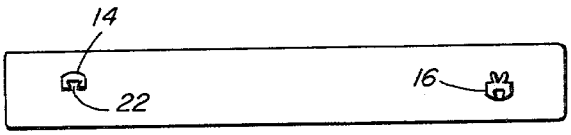
FIG. 2 is a top plan view thereof.

The stems 14 and 16, in practice, should be offset slightly from one another with resepct to the length of the base 12. As best shown in FIG. 2, the stem 14 is set on one side of the centerline of the base member while the stem 16 is located substantially on the opposite side thereof. In this fashion, the stems may be folded down in side by side relation and fit neatly one into the other.

Figure 8:
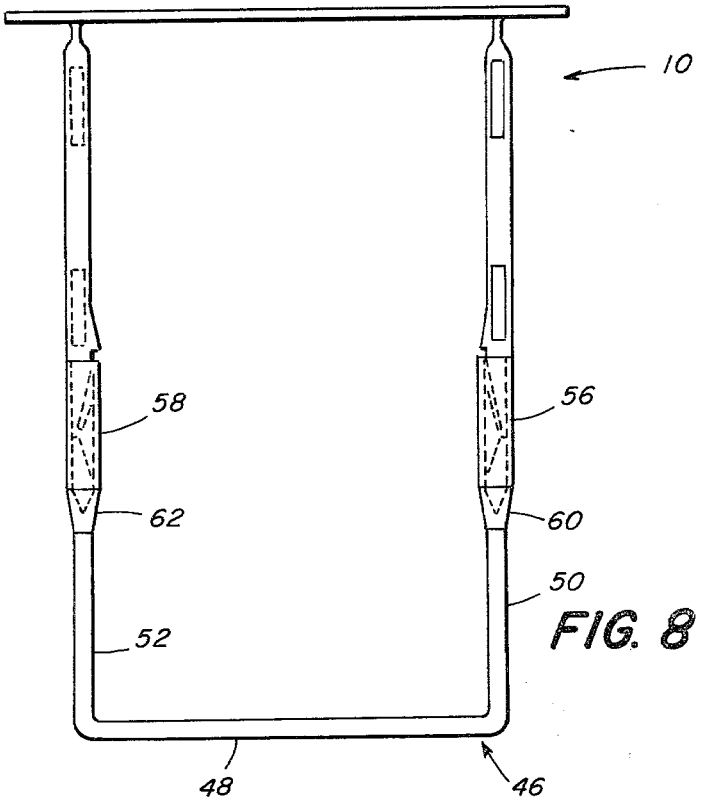
FIG. 8 is a view similar to FIG. 3 but showing a storage device much according to the invention attached to the device.

In FIG. 8 of the drawings there is illustrated a temporary paper storage attachment 46 connected to a binder 10. The attachment 46 is in the form of a U-shaped member having a cross-piece 48 and a pair of parallel legs 50 and 52, each terminating in a slightly enlarged socket head 56, 58. The socket heads 56 and 58 are formed each with a longitudinal socket adapted to receive the outer end of each stem 14 and 16 and the outside surfaces of the socket heads 56 and 58 jointly conform with the contours of the shank portion of the stems to provide a substantially smooth, continuous surface between the stems and the attachment 46. To this end the socket heads are tapered at 60 and 62 to provide easy movement of paper between the attachment and the stems. The attachment is connected to the stems by merely pressing the socket heads over the stems in the manner shown in FIG. 8. Paper may be transferred from the stems to the attachment 46 and any paper on the attachment together with the attachment may be separated from the stems. This will allow removal of one or more papers from within a stack of papers. The papers on the attachment may be returned to the stack by reconnecting the attachment and transferring the paper from the attachment back onto the stems.

Figure 9:
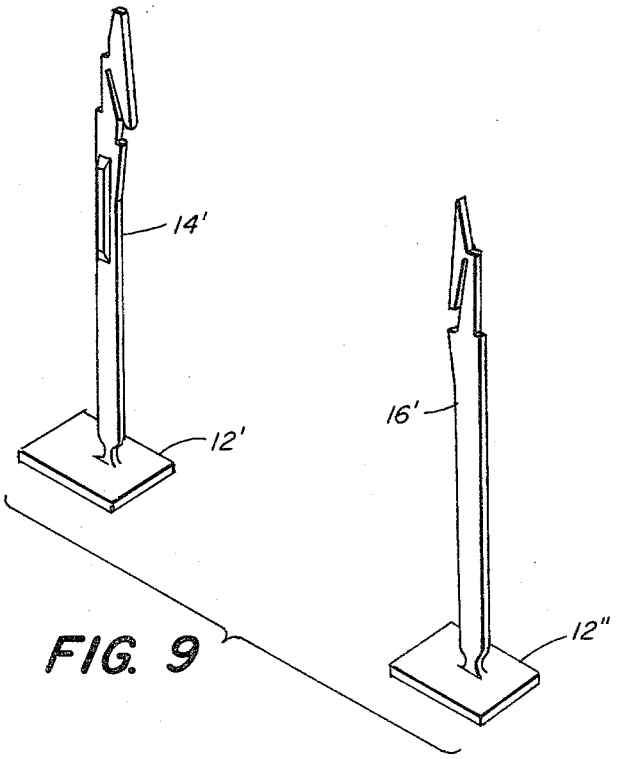
FIG. 9 is a view in perspective of modified binding devices made according to the invention.
Figure 12:
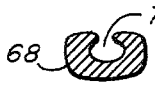
FIG. 12 is a cross-sectional view taken along the line 12—12 of FIG. 10.

Referring now to FIG. 9, there is illustrated a modification of the invention and, in this embodiment, stems 14', 16', similar in construction to the stems 14 and 16 of the principal embodiment, are provided as separate elements, each with individual base portions 12' and 12''. The individual stems and base portions operate in a manner similar to that of the one-piece binder unit of the principal embodiment, but since they are separate elements they are not limited to holes which are a fixed distance apart, as is the case with principal embodiment.

Figure 11:
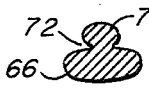
FIG. 11 is a cross-sectional view taken along the line 11—11 of FIG. 10.
Figure 14:
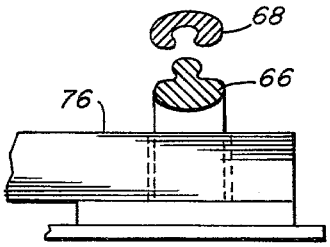
FIG. 14 is a cross-sectional view taken along the line 14—14 of FIG. 13.
Figure 10:
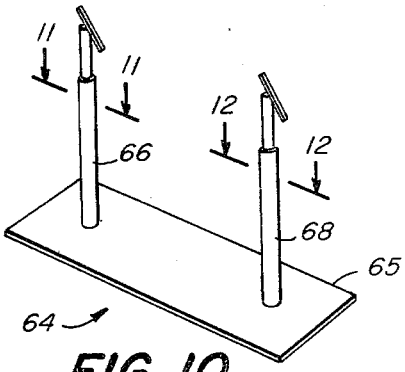
FIG. 10 is a view in perspective of a paper binding device made according to the invention.
Figure 15:
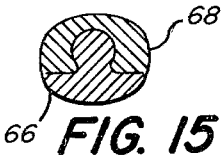
FIG. 15 is a cross-sectional view of the stems of FIG. 5, but shown in a fully locked position.
Figure 13:
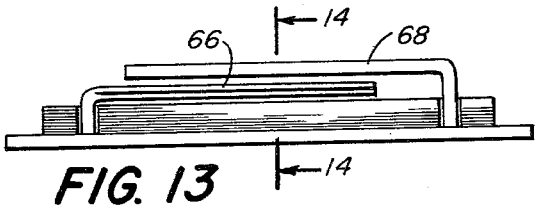
FIG. 13 is an end view showing the stems of the device folded over and in position just prior to locking.
Figure 18:
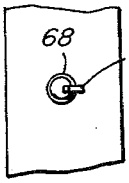
FIG. 18 is a top plan view of the stem shown in the FIG. 16 position.
Figure 19:
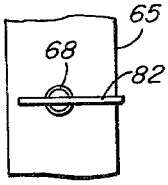
FIG. 19 is a view similar to FIG. 18 but showing the stop piece in the blocking position of FIG. 17.

Referring now to FIG. 10 of the drawings, there is illustrated another modification of the invention and, in this embodiment, a binder 64 is formed with a base portion 65 and a pair of stems 66 and 68. The lower shank portion of each stem is formed with longitudinal male and female locking elements. In the FIG. 10 embodiment, the stem 66 is formed along one side with a longitudinal rib 70, a cross-sectional view of which is best shown in FIG. 11, in which the rib is shown slightly wider at its outer portion and with a reduced neck 72 whereby the rib is contoured for mating cooperating engagement with a longitudinal groove 74 formed along one side of the stem 68. The groove 74 is similar in outline to the rib 70 having an enlarged inner portion and a reduced entrance. In this fashion, when the stems are folded one over the other with the stem 66 below the stem 68, the opposing stems may be pressed together, locking with one another as best shown in FIG. 15.

Insofar as the stems are of a resilient plastic material the mouth of the groove 74 will spread apart sufficiently for the rib 70 to be pressed into place. Once in place, the groove stem 68 will lock against the rib 70 on the stem 66 forming an effective binding connection which may be separated by peeling the upper stem 68 back along the lower stem 66. The stems are sufficiently flexible to be folded anywhere along their lengths so that a stack of paper 76 being bound may be in a wide range of thickness. The thickness should not be such, however, that the stems when folded over cannot overlap to perform the locking connection.

Figure 25:
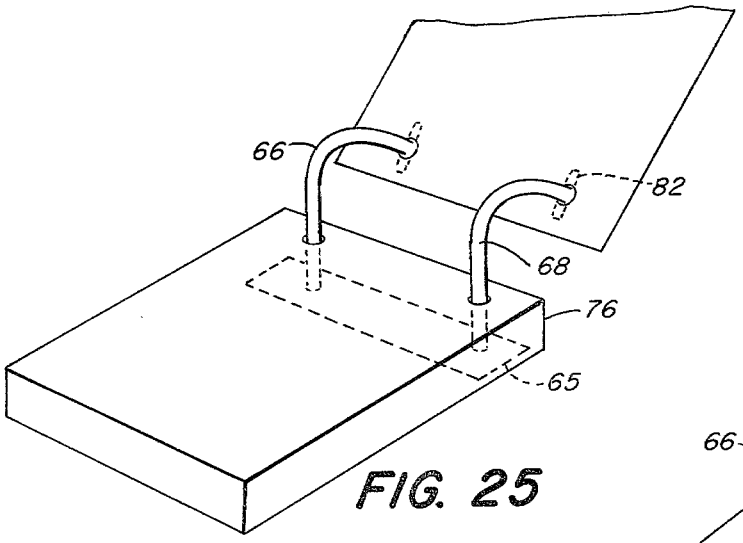
FIG. 25 is a view in perspective showing typical usage of the FIG. 10 device.
Figure 26:
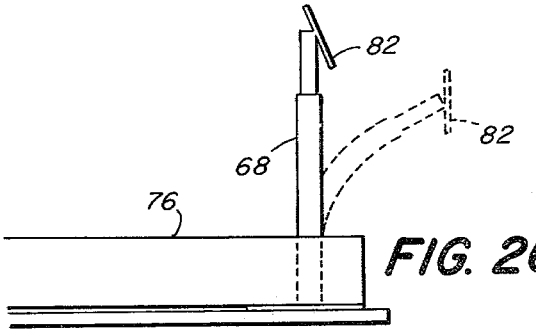

The upper end of such stems forms into a reduced portion 78 integral with the shank portion and having a length typically on the order of about ½". Attached to the upper end of the reduced portion 78 by means of a living hinge 80 is a stop bar 82. The connecting point of the hinge to the stop bar is off-center with the hinge 80, typically being located about one-third of the length of the bar from the upper end thereof as best shown in FIG. 16, with two-thirds of the bar being below the hinge. By connecting the bar to the stem in this fashion, the bar will tend to fold into the upright position of FIG. 16 most convenient for loading paper over the straight vertical stems. However, the bar will swing into a position generally perpendicular to the length of the stem if the stem is bent backwards in the manner suggested in FIGS. 25 and 26 where the stems are unclamped and the topmost papers in the stack are being moved upwardly to inspect lower papers. The attitude of the bar to the stem is such that, any paper actually moving upward along the stem will catch against the bar tending to move it in a perpendicular position shown in FIG. 17, effectively preventing papers from accidental separation from the binder.

Figure 28:
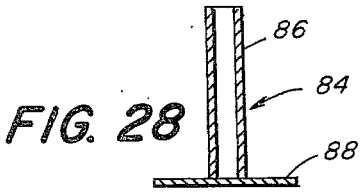
FIG. 28 is a sectional view in side elevation showing a temporary sheet storage element made according to the invention.
Figure 27:
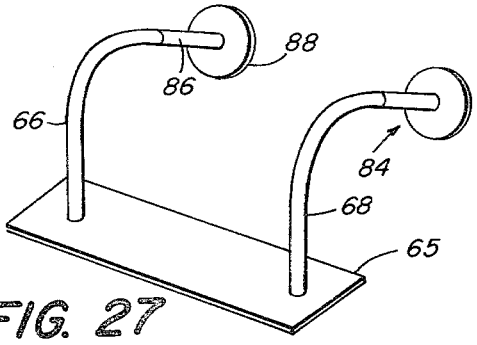
FIG. 27 is a view in perspective showing the FIG. 1 device in use with temporary sheet storage elements.

Very often it is necessary to separate an inner sheet of paper from a stack that has been bound and, heretofore, it had been necessary to separate entirely the uppermost papers from the stack, disconnecting the sheets from the binder in order to remove the particular particular papers from within the stack. Once the papers are separated from the stack, they are subject to being misaligned if disturbed so that the holes are no longer in register with one abother. Thus, replacing the topmost papers onto the stack over the binder stems a somewhat irritating and time consuming task. In FIGS. 27 and 28 however, there is shown a device which eliminates this problem. The device is comprised of an extension post 84 for attachment to each stem. The post includes a tubular shank portion 86 and a wide circular flange 88 at the end thereof. The upper end of the post is open and forms a socket having an inside diameter generally corresponding with the outside diameter of the reduced portion 78 of the stem. The outside diameter of the post is substantially equal to the outside diameter of the shank of the stem so that, when the post is pressed over the end of the stem, it will form a relatively smooth and continuous surface as suggested in FIG. 27. To use the extension posts 84, they are pressed over the ends of the stems and the topmost papers in the stack are transferred from the stems onto the posts. The posts may then be separated from the stems, allowing the particular papers in the middle of the stack to be removed over the stems. The posts then may be reconnected to the stems and the papers transferred back onto the stems in a quick and easy fashion.

Figure 29:
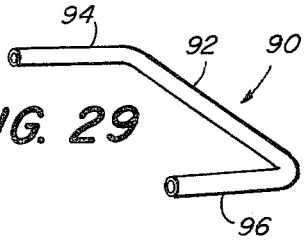
FIG. 29 is a view in perspective showing a modification of the sheet storage element.

In FIG. 29 there is illustrated a modification of the temporary storage attachment and, in this embodiment, a U-shaped, one-piece element 90 is provided. The element is formed with a cross-piece 92 and a pair of perpendicular legs 94 and 96 of tubular construction. The legs 94 and 96 are spaced apart by a distance corresponding to the distance between the stems and are detachably connected thereto in the same manner as the devices of FIGS. 27 and 28. The function of the device 90 is the same as that of the device in FIGS. 27 and 28, namely, to allow the transfer of the stack or portion thereof from the binder stems to a temporary storage arrangement without disorganizing the papers in the stack. The device may also be used to effectively extend the lengths of the stems for leafing through a large stack of papers.

Figure 21:
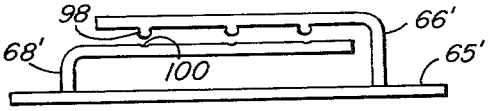
FIG. 21 is a top view showing a modification of the locking elements.
Figure 20:
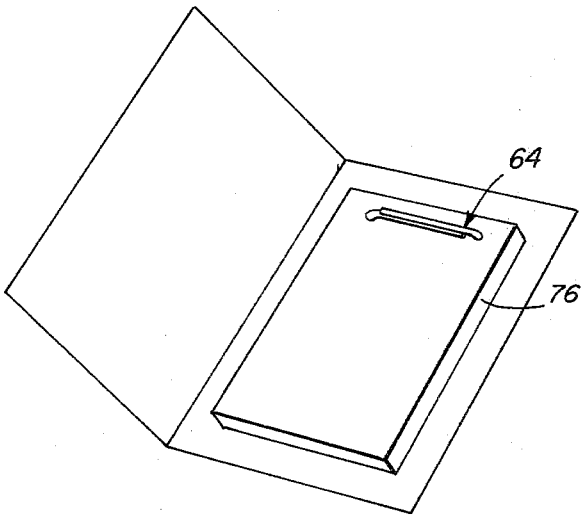
FIG. 20 is a view in perspective showing the binding device in typical use with a folder and a stack of paper.
Figure 22:
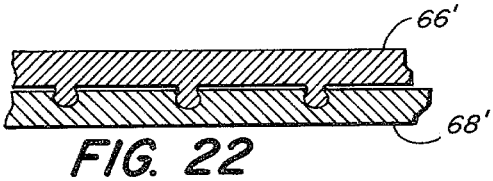
FIG. 22 is a top sectional detailed view of the FIG. 12 embodiment.

Referring now to FIGS. 21 and 22, there is illustrated another modification of the invention, and, in this embodiment, the stems lock to one another by means of a plurality or snap connections spaced along the lengths of the stems. The stem 66' is formed with a plurality of detents 98, somewhat mushroom-shaped, and adapted to snap into locking connection with cooperating indents 100 spaced along the shank of the stem 68'. The indents and detents are spaced evenly apart so that two or more of the snap connections can be made as long as there is sufficient overlap thereof.

Figure 23:
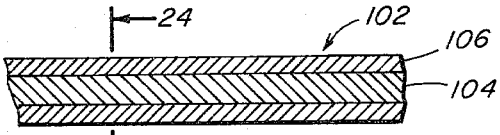
FIG. 23 is a detailed sectional view showing another modification of the invention.
Figure 24:
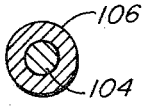
FIG. 24 is a cross-sectional view taken along the line 24—24 of FIG. 23.

Referring now to FIGS. 23 and 24, there is illustrated still another modification of the invention and, in this embodiment each stem 102 is formed with a metal wire core 104 and an outer plastic sleeve 106 tightly fitted thereto. The wire core preferably should be somewhat malleable so that it will retain the shape into which it is bent. Stems formed in this fashion thus may be bent one over the other and will remain in position until straightened.

Referring now to FIGS. 30 and 31, there is illustrated a still further modification of the invention and, in this embodiment, a binder 108 is illustrated for use with paper having three evenly spaced holes. The binder is comprised of a flat backing member 110 and three stems 112, 114 and 116 of different lengths by which they may be folded one over the other in the manner suggested in FIG. 30. In FIG. 30 the stems 114 and 116 are substantially the same length and are folded over in a manner similar to that of the FIG. 10 embodiment. The stem 112, however, is somewhat longer to allow it to be folded over on top of the stem 114 and lock therewith. As best shown in FIG. 31, the stem 116, which normally is folded first, is formed with a longitudinal rib 118 to lock with a cooperating longitudinal groove 120 in the stem 114. The stem 114 is formed on its opposite face with a rib 122 adapted to lock in a cooperating groove 124 formed in the stem 112. Thus, the three stems lock together to hold a stack of paper bound against the backing member. The backing member may, of course, be provided with means for attaching it to a folder, or the like, and for this purpose pressure sensitive adhesive, rivets, or other mounting means may be provided.

Figure 32:
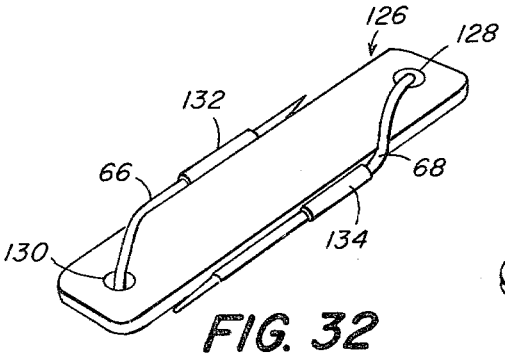
FIG. 32 is a view in perspective showing an optional compressor bar that may be used with the binding device, and, FIG. 33 is a view in perspective showing a modified compressor bar made according to the invention.
Figure 33:
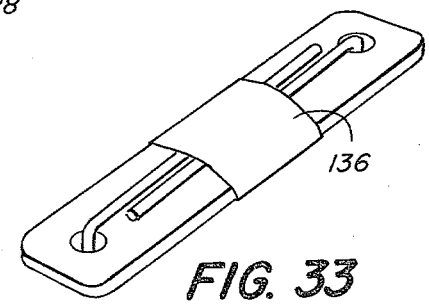

Referring now to FIGS. 32 and 33, there are illustrated two different optional compressor bars that may be used with the binders as shown herein. The compressor bars might be used where a particularly thick stack of papers is involved and it is desirable to provide alternate means for locking the stems down in place when folded. In the FIG. 32 embodiment, a compressor bar 126, which generally corresponds in size and shape with the base portion of the binder and, preferably, is of the same material, is formed with a pair of openings 128 and 130 spaced apart by a distance corresponding to the distance between the stems 66 and 68. The stems 66 and 68 pass through the openings 128 and 130 and are bent in under a pair of side wings 132 and 134 located along opposite side edges of the compressor bar. The compressor bar is disconnected by merely detaching the stems from their respective wings, straightening the stems to some extent and then lifting the compressor bar away from the stems.

In the compressor bar embodiment of FIG. 33, an arched retainer 136 extends over the top of the compressor bar to receive the stems which are bent in under the arched retainer to hold them in place. Again, the compressor bar is disconnected by merely pulling the stems out from under the arched retainer, generally straightening them and then lifting the compressor bar.

While the invention has been described with particular reference to the illustrated embodiments, numerous modifications thereto will appear to those skilled in the art. For example, in place of the mechanical means shown for locking the stems to one another when folded, other securing means may be utilized such as releasable pressure sensitive adhesives of the type presently available that may be joined and separated repeatedly with no significant loss of binding strength.

Having thus described the invention, what I claim and desire to obtain by Letters Patent of the United States is:

1. A device for binding a stack of paper sheets in which the stack is formed with at least two spaced holes therethrough, comprising (a) a cross-piece, (b) at least a pair of semi-flexible foldable stems extending from one face of said cross-piece, (c) said stems when folded into an open position with said stems generally parallel to one another and perpendicular to said cross-piece are spaced apart from one another by a distance substantially equal to the distance between holes in a stack of paper sheets, (d) said stems when parallel and perpendicular to said cross-piece adapted to be threaded through holes in a stack of paper sheets and each stem having a length sufficient to overlap an adjacent stem when both stems are folded into a closed position against the top of a stack of paper sheets parallel to said cross-piece, (e) each of said stems being formed along the length thereof with cooperating locking means for locking engagement between adjacent stems when folded one against the other, (f) each of said stems being formed also with integral retractable stop means at the distal end thereof for resulting separation of sheets from said stack.

2. A device according to claim 1 wherein said locking means includes a male locking member formed along the length of one of said stems and a female locking member formed along the length of an adjacent stem, said male and female members being located on said stems so as to be in opposing relation when folded into a closed position,

3. A device according to claim 2 wherein said male locking means includes a rib formed lengthwise of said one stem and said female locking means includes a mating groove formed lengthwise of said adjacent stem.

4. A device according to clam 3 wherein said rib is formed with a relatively wide outer portion and a relatively narrow inner portion and said groove is formed with a relatively narrow entrance and a relatively wide inner portion.

5. A device according to claim 2 wherein said locking means includes a plurality of detents spaced evenly along the length of said one stem and a plurality of indents spaced evenly by similar distances along the length of an adjacent stem.

6. A device according to claim 1 wherein said stop means at the end of each of said stems having two operative positions said stop means in one position allowing placement and removal of sheets on and from said stems and in another position preventing placement and removal of said sheets on and from said stems.

7. A device according to claim 6 wherein said stop means includes a bar hinged to the end of said stem and movable from a position generally lengthwise of said stem to a position generally perpendicular to said stem, said bar having a length greater than the diameter of each of the holes in a stack of paper sheets.

8. A device according to claim 7 wherein said bar is hinged off-center to said stem whereby said bar will swing into a position generally lengthwise of said stem when said stem is in a generally vertical position and will swing in a position generally perpendicular to said stem when said stem is in a generally horizontal position.

9. A device according to claim 1 including extension means detachably connected to the ends of said stems for transferring at least a portion of said stack from said stems to said extension means.

10. A device according to claim 9 wherein said extension means includes a tubular member formed with a flange at one end thereof.

11. A device according to claim 9 wherein said extension means includes a tubular U-shaped member formed with a cross-piece and a pair of parallel legs spaced from one another by a distance generally equal to the distance between said stems.

12. A device according to claim 1 in combination with a compressor bar, said bar being formed with a hole for each stem and retaining means for engaging stems through said holes and bent against said compressor bar.

13. A device according to claim 1 including a stratum of pressure sensitive adhesive on the other face of said cross-piece and a release sheet covering said stratum.

* * * * *